US007503439B2

(12) United States Patent
O'Shea et al.

(10) Patent No.: US 7,503,439 B2
(45) **Date of Patent: *Mar. 17, 2009**

(54) RETRACTABLE WHEEL ASSEMBLY

(75) Inventors: Timothy J. C. O'Shea, 127 NE. 60th St., Seattle, WA (US) 98115; Terence R Ellard, Seattle, WA (US); Wayne C Higgins, Seattle, WA (US)

(73) Assignee: Timothy J. C. O'Shea, Seattle, WA (US)

( * ) Notice: Subject to any disclaimer, the term of this patent is extended or adjusted under 35 U.S.C. 154(b) by 236 days.

This patent is subject to a terminal disclaimer.

(21) Appl. No.: 11/352,742

(22) Filed: Feb. 13, 2006

(65) Prior Publication Data

US 2006/0124417 A1 Jun. 15, 2006

Related U.S. Application Data

(63) Continuation of application No. 10/961,689, filed on Oct. 8, 2004, now Pat. No. 7,066,311.

(60) Provisional application No. 60/510,320, filed on Oct. 10, 2003.

(51) Int. Cl.
*A45C 5/00* (2006.01)
*A45C 13/26* (2006.01)

(52) U.S. Cl. ..... 190/18 A; 190/115; 280/37; 280/655; 280/47.315; 16/18 CG; 16/34

(58) Field of Classification Search ..... 190/18 A, 190/115; 280/37, 655, 47, 315; 16/18 CG
See application file for complete search history.

(56) References Cited

U.S. PATENT DOCUMENTS

| | | | | |
|---|---|---|---|---|
| 44,936 A | | 11/1864 | Clapp | |
| 1,145,096 A | | 7/1915 | Thomes | |
| 2,439,660 A | | 4/1948 | Keil | |
| 2,472,491 A | | 6/1949 | Quinton | |
| 2,581,417 A | * | 1/1952 | Jones | 280/645 |
| D184,292 S | * | 1/1959 | Scanlon | D8/375 |
| 3,141,680 A | * | 7/1964 | McCord et al. | 280/38 |
| 3,917,038 A | | 11/1975 | Føge et al. | |
| 4,007,512 A | | 2/1977 | Oland | |
| 4,254,850 A | | 3/1981 | Knowles | |
| 4,773,123 A | | 9/1988 | Yu | |
| 4,852,705 A | * | 8/1989 | Cowan, Jr. | 190/18 A |
| 4,979,598 A | | 12/1990 | Verheij et al. | |
| 5,114,164 A | | 5/1992 | Bothwell et al. | |
| 5,533,231 A | | 7/1996 | Bai | |
| 5,813,503 A | | 9/1998 | Chang | |
| 6,227,339 B1 | * | 5/2001 | Bogert | 190/18 R |
| 6,360,400 B1 | * | 3/2002 | Chang | 16/113.1 |

(Continued)

*Primary Examiner*—Tri M Mai
(74) *Attorney, Agent, or Firm*—Christensen O'Connor Johnson Kindness PLLC

(57) ABSTRACT

A retractable wheel assembly (110) for a carrier (100) is disclosed wherein the wheels (120) are rotatably mounted in cowls (130), which are pivotably disposed in wheel wells (116L, 116R) on a housing. The cowls are connected with a cowl axle assembly (140) that includes a coil spring, preferably a constant force spring (150) that biases the cowls towards a retracted position. The constant force spring is connected to a retractable handle (104), preferably with a spring engagement member (160), such that extending the retractable handle will bias the cowls towards an extended position, wherein the wheels extend out of the wheel wells for use.

19 Claims, 6 Drawing Sheets

U.S. PATENT DOCUMENTS 6,604,615 B2 8/2003 Wu
6,612,411 B2 9/2003 Nykoluk et al.
7,066,311 B2 * 6/2006 O'Shea ..... 190/18 A
2003/0085088 A1 5/2003 Wu

* cited by examiner

RETRACTABLE WHEEL ASSEMBLY

CROSS-REFERENCE TO RELATED APPLICATION

This application is a continuation of U.S. patent application Ser. No. 10/961,689, filed Oct. 8, 2004 which claims the benefit of Provisional Application No. 60/510,320, filed Oct. 10, 2003, the benefit of which is hereby claimed under 35 U.S.C. § 119 and 35 U.S.C. § 120.

FIELD OF THE INVENTION

The present invention relates to carriers such as luggage and backpacks and, more particularly, to wheel systems for such carriers.

BACKGROUND OF THE INVENTION

Luggage, backpacks, and other apparatus for carrying gear such as clothing, books, and personal items are widely used for many different applications. Luggage is, of course, indispensable for travelers, and may be quite large and bulky. Backpacks are used not only for outdoor activities such as camping and hiking, but also, for example, by students to carry books and the like, and by others for carrying personal items. Modern materials and construction methods have increased the strength and capacity of such carriers, allowing the user to significantly increase the loaded weight of the carrier. Moreover, travelers often elect to carry their luggage onto the aircraft or other transportation, rather than checking their bags. Although carry-on luggage may significantly reduce the time required at the airport, this may require the traveler to carry a heavy bag a relatively long distance, e.g., through the airport concourse. As the population ages, however, many travelers may be unable and/or unwilling to carry a heavy container over a long distance. Similarly, improved backpacks have enabled students to carry more books and other items to and from school. Often, however, the student must carry the heavy backpack a significant distance.

Wheeled carriers have been developed that address some of the difficulties associated with transporting relatively heavy loads over relatively long distances. Typically, a frame for the carrier includes two or more fixed wheels mounted on the bottom of the carrier, and a retractable handle or a strap may be provided at one end, allowing the carrier to be pulled on the wheels by the user. Such wheeled systems have been very helpful at alleviating the difficulties discussed above, and are used widely.

Fixed wheel systems, however, have several disadvantages. In backpacks, for example, the fixed wheels can interfere with or generate discomfort when carrying the backpack and/or can result in soiling the user's clothes when the backpack is carried on the user's back. Also, fixed wheels are susceptible to being damaged during handling—for example, by baggage handling equipment when such luggage is checked through on a flight. Fixed wheel systems may also get in the way during storage and are aesthetically unappealing. To alleviate these problems, some fixed wheel systems use very small wheels. Small wheels, however, can be very difficult on which to pull heavy weights, particularly on a textured surface, and may be virtually useless on rough surfaces.

Retractable wheel systems have been proposed, but prior art retractable wheel systems are relatively complicated, expensive to produce, and prone to damage or malfunction. In particular, many prior art retractable wheel systems utilize a plurality of levers to extend and lock and/or retract the wheels. Such lever systems are susceptible to misalignment, loss of pivot pins, bending of the lever arms, and the like. Lever systems also typically lock rigidly into place, which can cause damage during use—for example, when the carrier is pulled over uneven terrain. They may also be difficult to extend and retract and/or may retract unexpectedly during use. The systems also typically require a relatively large clearance space to accommodate the lever arms, reducing the available volume in the carrier.

There remains a need, therefore, for a retractable wheel system for carriers, which is simple, reliable, inexpensive to produce, and easy to use.

SUMMARY OF THE INVENTION

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A retractable wheel assembly for a carrier, such as a piece of luggage, a backpack, or the like, is disclosed. In a preferred embodiment, the retractable wheel assembly includes a housing or container having two or more wheels. Left and right wheels are rotatably mounted on corresponding support structure, for example a cowl or other structure suitable for rotatably supporting the wheels. An axle interconnects the support structures for the left and right wheels, and is pivotably attached to the container. The axle pivots about an axis that is offset from the wheel rotational axes, such that pivoting the axle will cause the wheels to move between an extended position and a retracted position. For example, pivoting the axle may move the left and right wheels into, or out of, corresponding wheel wells associated with the carrier. The assembly may also include a retractable handle that is coupled to the wheel assemblies such that retracting the handle causes to the left and right wheels to move, or be biased towards, the retracted position.

In an embodiment of the invention a spring is coupled to the axle, such that the axle is biased towards the extended position when the handle is in the extended position.

In an embodiment of the invention the wheels are mounted in cowls, and the include a cowl stop projecting from an outer surface of the cowl that engages the housing to limit the rotation of the cowl.

In an embodiment of the invention the housing includes a plurality of standards that support the housing such that the wheels are elevated.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
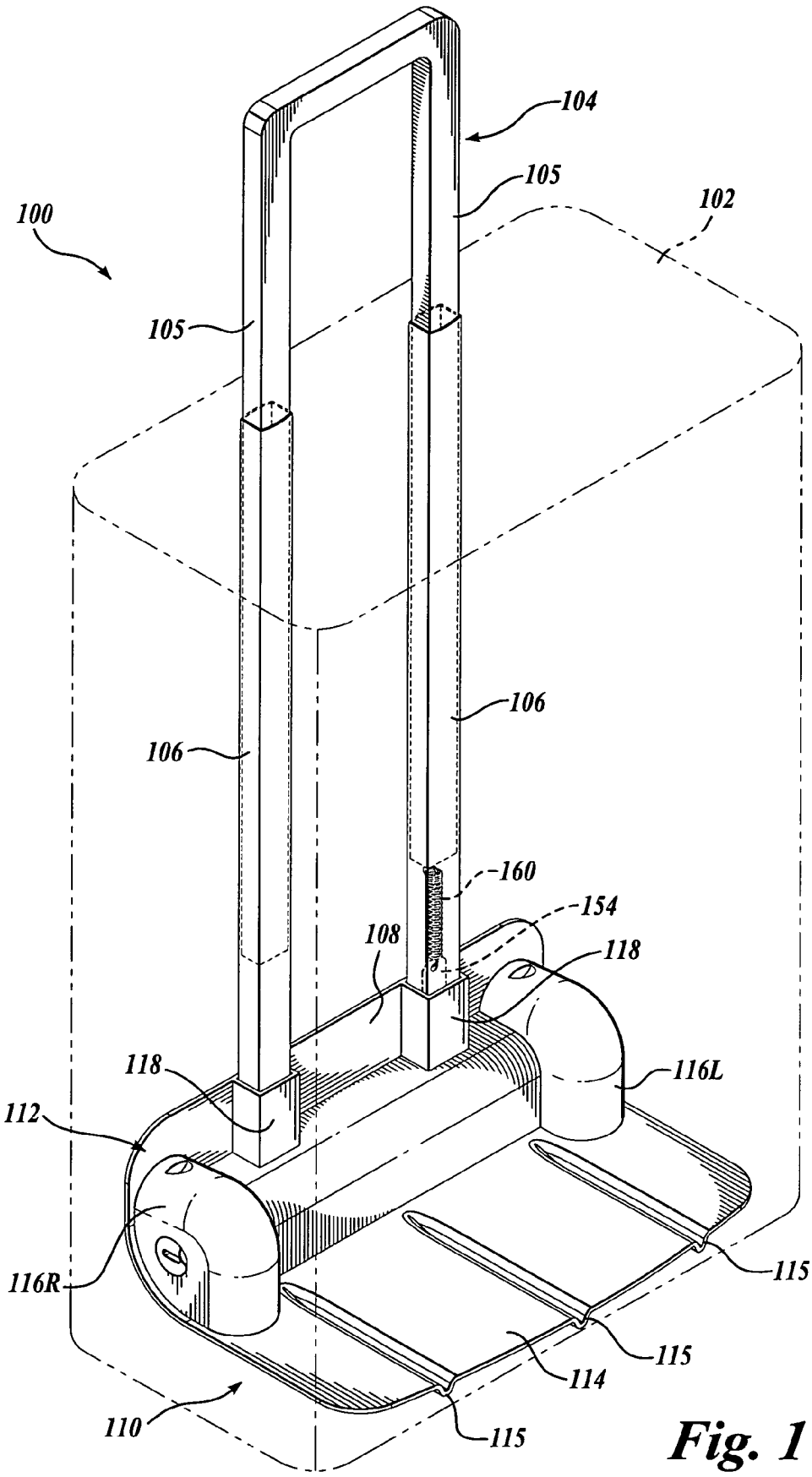
FIG. 1 is a perspective view of a carrier incorporating an embodiment of the present invention, with the container portion shown in phantom.

Referring now to the figures, wherein like numbers indicate like parts, a currently preferred embodiment of the present invention will be described. FIG. 1 shows a carrier assembly 100, such as a piece of luggage or a backpack having a telescoping handle portion 104, wherein a closable container portion 102 is shown in phantom, to show the other components more clearly. Persons of ordinary skill in the art will recognize that the container portion 102 and the retractable handle portion 104 may be any of a very large number of forms as are well known in the art, the details of which are not important to the present invention. For example, and not by way of limitation, the container portion 102 may be a relatively rigid or semi-rigid rectangular structure having a lid pivotally connected to a box structure. On the other hand, the container portion may be a flexible structure—for example, a nylon or canvas container—having any number of internal and external pockets and dividers, and with or without an internal frame (not shown). The container portion 102 may include one or more straps (not shown), whereby the carrier assembly 100 may be carried on the back of the user. Alternatively, handles (not shown) may be attached to the container portion 102 or to other parts of the carrier assembly 100 to facilitate carrying the assembly.

Similarly, the retractable handle portion 104 is generally an elongate structure and may comprise one, or more than one, post 105 (two shown) that telescopically engages one or more upright tubes 106 behind the container portion 102. The retractable handle portion 104 may be of tubular construction, for example and not by way of limitation, and may include a handle grip and/or contoured portion at an upper end. The retractable handle portion 104 may include a mechanism (not shown) for locking the handle portion 104 in the extended position and/or in the retracted position. Such mechanisms are well known in the art, including, for example, mechanisms utilizing a depressible button to selectively disengage the locking mechanism. Although two upright tubes are shown in the preferred embodiment, it will be readily apparent that one tube, or more than two tubes, could alternatively be used and the tubes 106 and posts 105 may be curved, for example, to accommodate the user's back, or for aesthetic reasons.

The container portion 102 is attached to a wheel assembly 110, disposed generally below and behind the container portion 102. In the disclosed carrier assembly 100, the wheel assembly 110 includes a housing 112 having a substantially planer base portion 114 that may include a plurality of elongate projections, or standards 115, and left and right wheel wells 116L, 116R. A wall portion 108 that may be formed integrally with the base portion 114, extends generally vertically therefrom. The upright tubes 106 fixedly engage the housing 112, for example, through orifices 118.

Figure 2:
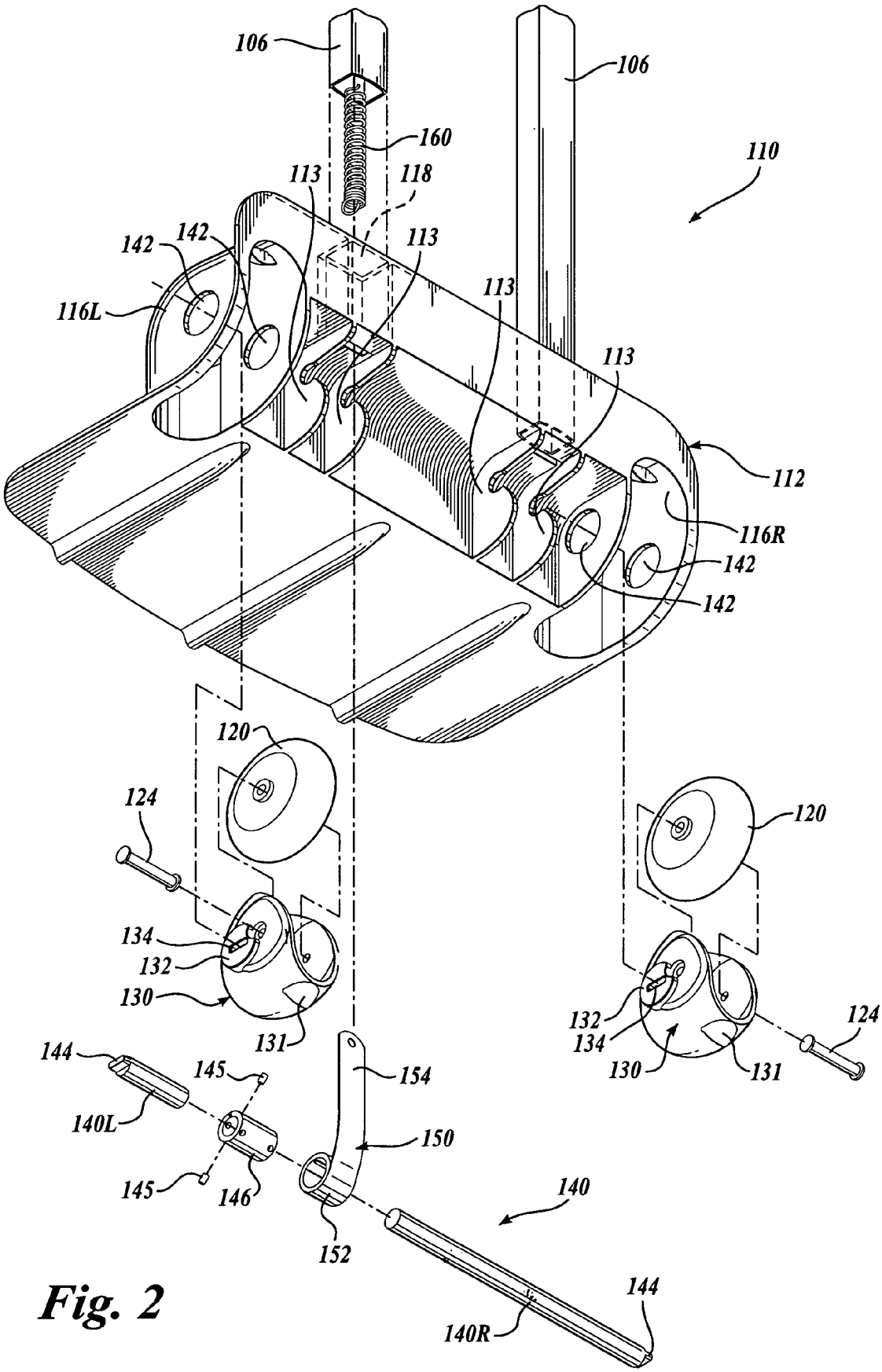
FIG. 2 is an exploded view of the wheel assembly of the carrier shown in FIG. 1.
Figure 3:
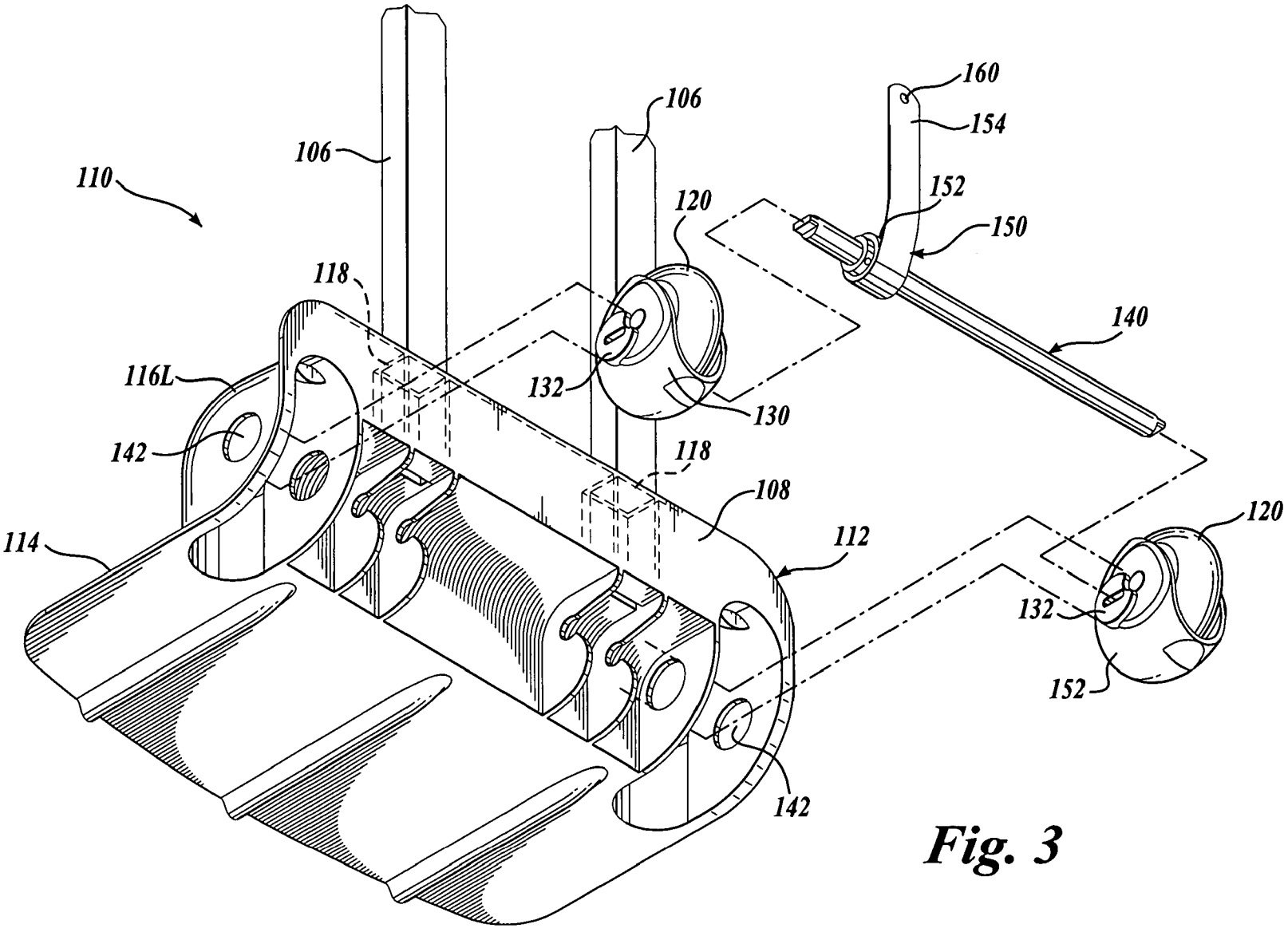
FIG. 3 is a partially exploded view of the wheel assembly of the carrier shown in FIG. 1.

A more detailed construction of the currently preferred wheel assembly 110 can be seen in FIGS. 2 and 3. FIG. 2 shows an exploded perspective view of the wheel assembly 110, and FIG. 3 shows a partially exploded view of the wheel assembly 110. The housing 112 includes a pair of deep, generally rectangular orifices 118 (one shown) that is adapted to slidably receive the upright tubes 106. Mounting hardware, such as screws, bolts, set screws, or the like (not shown) may be used to secure the upright tubes 106 to the housing 112. Alternatively or in addition, a friction fit, mechanical locking geometry and/or fixative may be used to secure the upright tubes 106 to the housing 112.

Wheels 120 are rotatably mounted in corresponding cowls 130 with an axle assembly 124. In the preferred embodiment, the wheels 120 are substantially made of a durable polyurethane material similar to wheels made for recreational devices, such as in-line skates. It is contemplated, however, that other types of wheels may alternatively be used-including, for example, hard plastic wheels or softer rubber or synthetic rubber wheels.

Each cowl 130 is shaped to enclose most of the corresponding wheel 120, with a relatively smaller portion of the wheel 120 extending out of the cowl 130. The cowls 130 are shaped to approximately conform to the shape of the wheels 120, with sufficient space therebetween to permit the wheel 120 to rotate freely. Each cowl 130 includes a pair of axially aligned, oppositely disposed, substantially circular axle stubs 132 that extend outwardly from the cowl 130. The axis of the axle stubs 132 is offset somewhat from the wheel 120 rotational axis, such that a partial rotation of the cowl 130 about the axis of the axle stubs 132 will cause the wheel 120 mounted therein to be displaced. The axis of rotation of the cowls 130 is parallel to the axis of rotation of the wheels 120. At least the inwardly facing axle stubs 132 include a keyed aperture 134. An exterior surface of the cowls 130 also includes an outwardly projecting stop 131, whose function is discussed below.

The left and right wheel wells 116L, 116R have opposed circular apertures 142 that are sized and spaced to engage the corresponding axle stubs 132 of the cowls 130, such that the cowls 130 are pivotably retained in a corresponding wheel well 116L, 116R. A cowl axle assembly 140 extends between the cowls 130. The cowl axle assembly 140 includes oppositely disposed keyed projections 144 that are adapted to engage the keyed apertures 134 of the cowls 130, the cowl axle assembly 140 thereby drivably engaging both cowls 130. In the disclosed embodiment the cowl axle assembly 140 includes a left axle portion 140L, a right axle portion 140R, and a connecting tube 146 disposed therebetween. The left and right axle portions 140L, 140R may be fixedly attached to the connecting tube 146 by any suitable method as is well known in the art, including, for example, with an appropriate adhesive, or mechanically, i.e., with a set screw (not shown). It will be appreciated that in the preferred embodiment the cowl axle assembly 140 may be easily adapted to accommodate various wheel spacing by simply replacing the left and right axle portions 140L, 140R to achieve the desired spacing. It will be appreciated that this aspect of the preferred embodiment allows use of many interchangeable parts across different carrier assembly models.

The housing 112 includes a plurality of spaced axle guides 113 that are adapted to receive and support the cowl axle assembly 140 without substantially interfering with rotation of the cowl axle assembly 140. When the cowl axle assembly 140 is properly installed in the housing 112, the cowls 130 and wheels 120 are disposed substantially in the wheel wells 116L, 116R.

A coil spring, preferably a constant force spring 150, is attached to the cowl axle assembly 140, for example, with a plurality of radial posts 145, thereby fixedly engaging the connecting tube 146. A constant force spring has many advantages, including long deflections at nearly constant torque, bidirectional torque capability, minimal intercoil friction, and high initial force. The spring 150 includes a coil portion 152 and an extending portion 154 extending upwardly from the coil portion 152. The spring 150 engages the cowl axle assembly 140, providing a biasing force to the cowls 130 through the cowl axle assembly 140, as discussed below. A spring engagement member 160, which may be a conventional extension spring (as shown), is connected to the distal end of the extending portion 154 of the spring 150. Although an extension spring is shown for the spring engagement member 160, is will be readily apparent to the artisan that other mechanisms may alternatively be utilized to engage the spring 150, including for example a telescoping rod, an elastic polymeric band, a second constant force spring, a cable, and similar mechanisms that are capable of affecting the desired connection between the spring 150 and the handle 104, as will be better understood from the following disclosure.

Figure 4:
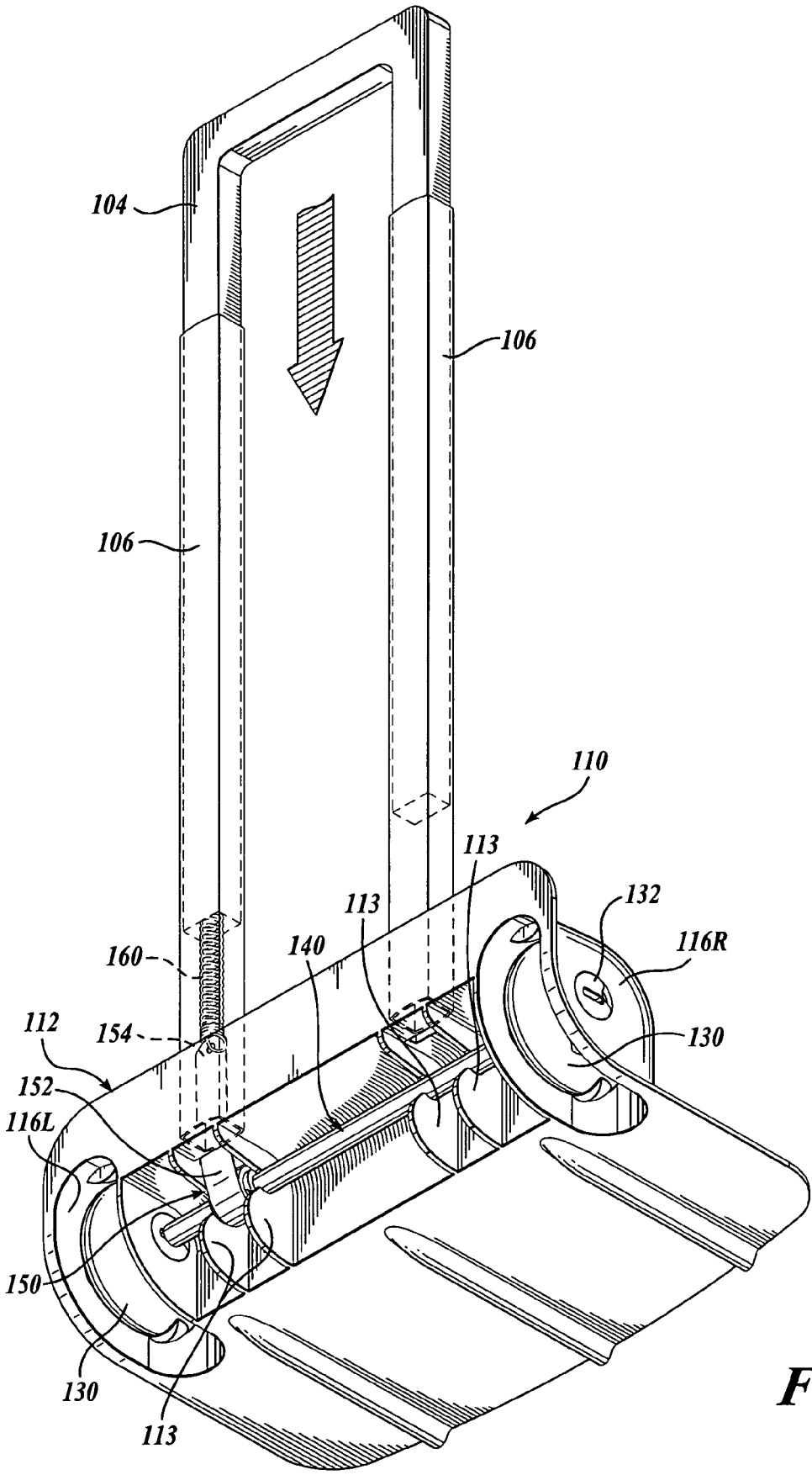
FIG. 4 is an assembled perspective view of the wheel assembly of the carrier shown in FIG. 1, showing the wheels retracted.
Figure 5:
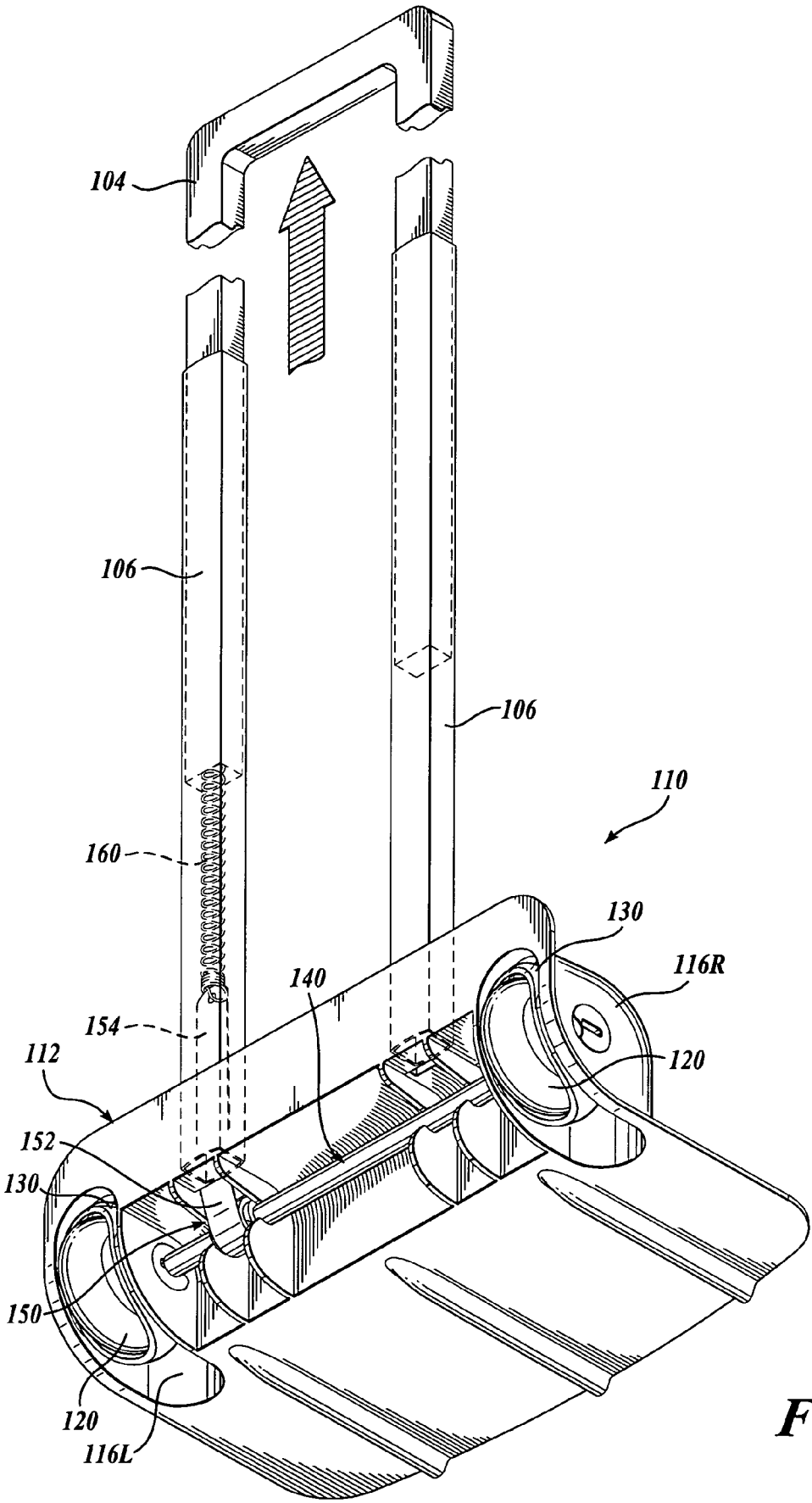
FIG. 5 is an assembled perspective view of the wheel assembly of the carrier shown in FIG. 1, showing the wheels extended.

As seen most clearly by comparing FIG. 3 with FIGS. 4 and 5, the extending portion 154 of the spring 150 extends upwardly through one of the orifices 118 of the housing 112, and into one of the upright tubes 106. The spring engagement member 160 connects to the retractable handle portion 104. When the retractable handle portion 104 is in the retracted position, i.e., in the downward position as indicated by the arrow in FIG. 4, the spring engagement member 160 is relatively relaxed. When the retractable handle portion 104 is in the extended position, as indicated by the arrow in FIG. 5, the spring engagement member 160 is biased upwardly, exerting an upward force on the extending portion 154 of the spring 150.

The operation of the extendible wheel assembly 110 will now be described with reference to FIGS. 4-7. FIG. 4 shows the wheel assembly 110 with the wheels 120 (not visible in FIG. 4) retracted and covered by the cowls 130. The retractable handle 104 is also retracted. In the retracted position the cowls 130 are biased by the constant force spring 150 toward a position such that the cowls 130 are disposed generally outwardly, toward the opening of the wheel wells 116L, 116R, and the wheels 120 are hidden and disposed entirely within the wheel wells 116L, 116R.

Figure 6:
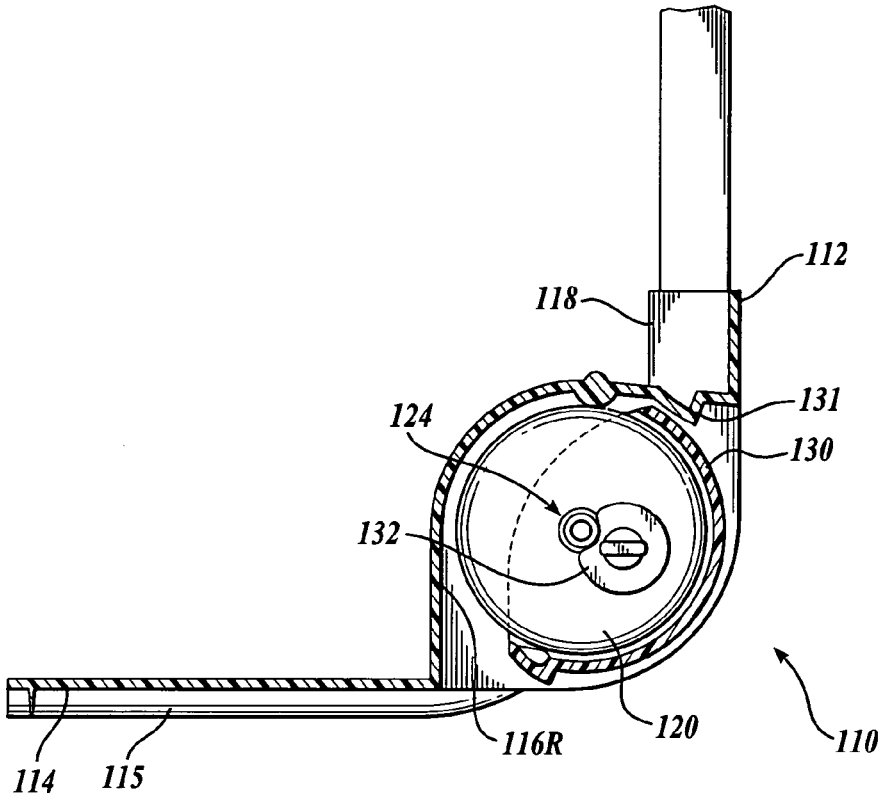
FIG. 6 is a cross-sectional side view of the wheel assembly of the carrier shown in FIG. 1, showing the wheels retracted.

As seen most clearly in FIG. 6, which shows a cross-sectional side view of the retracted wheel assembly 110 in the retracted position, the axle assembly 124 mounting the wheel 120 is disposed inwardly of the cowl 130 axis stubs 132. The benefit of offsetting the cowl 130 axis from the wheel 120 axis should now be apparent. When the cowl 130 is in the retracted position, the wheel 120 is disposed upwardly and inwardly. It will be appreciated that the cowl 130 in this position substantially covers the portion of the wheel 120 that would otherwise be exposed, thereby protecting the user from any dirt and grime that may have accumulated on the wheel 120. The spring 150 (FIG. 5) is installed with a preloaded tension such that the spring 150 biases the cowl axle assembly 140 and, therefore, the cowls 130 toward the retracted position (clockwise in FIG. 6) when the telescoping handle 104 is retracted.

FIG. 5 shows the wheel assembly 110 with the cowls 130 rotated such that the wheels 120 are extended. The retractable handle portion 104 is also extended. In the extended position the cowls 130 are rotated into the wheel wells 116L, 116R, exposing and positioning the wheels 120 for rolling use.

Figure 7:
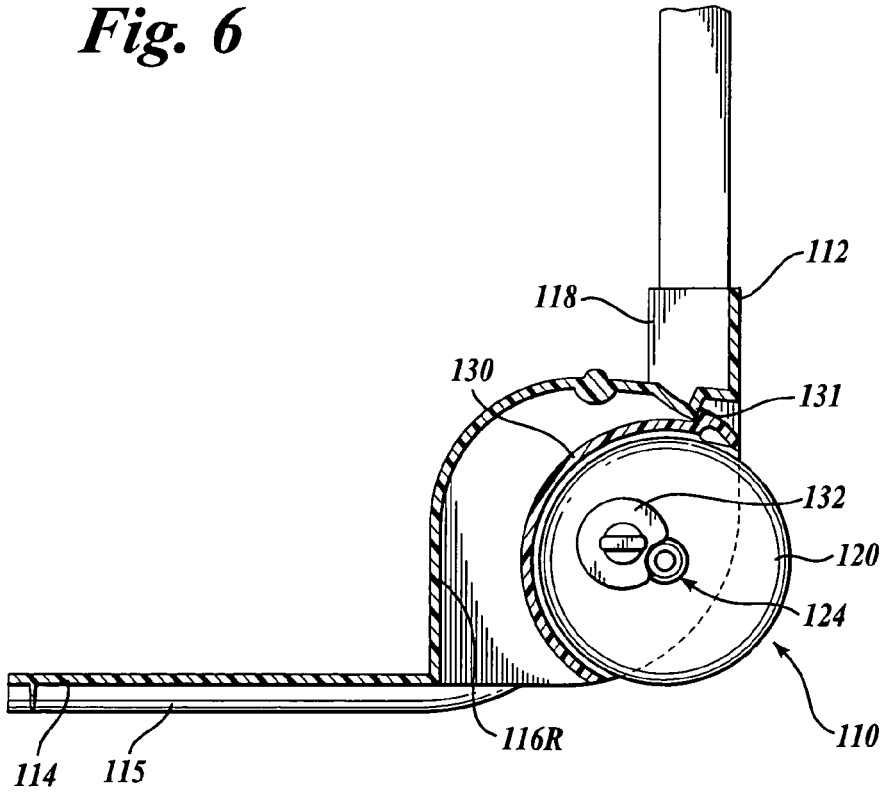
FIG. 7 is a cross-sectional side view of the wheel assembly of the carrier shown in FIG. 1, showing the wheels extended.

As seen most clearly in FIG. 7, which shows a cross-sectional side view of the extended wheel assembly 110 in the extended position, the axle assembly 124 for the wheel 120 is disposed outwardly of the cowl 130 axle stubs 132, so the wheel 120 is disposed outwardly and downwardly. When the retractable handle portion 104 (FIG. 5) is extended, the spring engagement member 160, which is attached to the retractable handle portion 104, displaces the extended portion 154 of the spring 150 upwardly, causing the coil portion 152 of the spring 150 to partially uncoil, thereby generating a biasing force toward the open position (counterclockwise in FIG. 7). The cowl stop 131 on the cowl 130 engages or abuts an edge of the housing 112, preventing over-rotation of the cowl 130. The spring engagement member 160 is preferably selected to permit the retractable handle portion 104 to extend a significant distance without the spring engagement member 160 exerting sufficient force to overcome the preloaded bias of the constant force spring 150. At a design point where the retractable handle portion 104 is extended sufficiently, the spring engagement member 160 will exert sufficient force to the spring 150, thereby rotating the cowl axle assembly 140, and extending the wheels 120.

It will be appreciated from FIGS. 5 and 7 that an advantage of this disclosed embodiment of the wheel assembly 110 is that when the wheels 120 are in the extended position, for use in rolling the carrier assembly 100, the normal force exerted on the wheel assembly 110 (i.e., through the wheels 120) tends to maintain the wheels 120 in the extended position. The wheels 120 therefore are prevented from inadvertently closing by the weight of the carrier assembly 100 and the contents thereof.

It will also be appreciated from FIGS. 6 and 7 that, in the disclosed embodiment, the wheels 120 do not need to move far to move between the retracted position (FIG. 6) and the extended position (FIG. 7) and, therefore, the wheel wells 116L, 116R can be relatively small. Moreover, the projections or standards 115 on the base 114 of the wheel assembly 110 may be sized to support the container with the wheels 120 slightly elevated such that the wheels 120 are able to move between the extended and retracted positions without lifting the carrier assembly 100.

While the preferred embodiment of the invention has been illustrated and described, it will be appreciated that various changes can be made therein without departing from the spirit and scope of the invention. For example, although a single spring 150 and engagement member 160 is currently preferred, it should be appreciated that multiple spring/engagement member assemblies may be utilized. Also, the upright tubes 106 may be curved, for example, to make the assembly more comfortable for carrying, if shoulder straps are provided. Although the cowl axle assembly 140 connecting the cowls 130 is shown comprising a generally cylindrical rod, it will be appreciated that the cowl axle assembly 140 may not be circular in cross section.

It is contemplated that the present invention may be employed in a number of different applications, including without limitation, to luggage, backpacks, musical instrument cases, waste containers, water dollies, picnic coolers, and the like.

The embodiments of the invention in which an exclusive property or privilege is claimed are defined as follows:

1. A retractable wheel assembly for a carrier comprising:

a retractable handle that is movable between an first position and a second position:

a closable container attached to the retractable handle;

a left wheel support structure, a right wheel support structure, and an axle drivably attached to the left and right wheel support structures, the axle being pivotably attached to the closeable container such that the axle is pivotable about a first axis, the axle being pivotable to drive the left and right wheel support structures between an extended position and a retracted position; and a right wheel rotatably mounted to the right wheel support structure and a left wheel rotatabily mounted to the left wheel support structure the left and right wheels each having a diameter, wherein the left and right wheels rotate about a second axis that is offset from the first axis and further wherein the first axis is disposed within the diameter of the left and right wheels.

2. The retractable wheel assembly of claim 1, further comprising a spring attached to the axle, the spring biasing the axle towards one of the extended position and the retracted position.

3. The retractable wheel assembly of claim 2 wherein the left wheel support structure and the right wheel support structure comprise left and right cowls that enclose most of the left and right wheels.

4. The retractable wheel assembly of claim 3, wherein each of the left and right cowls include stub axles that pivotably support the cowls.

5. The retractable wheel assembly of claim 2, wherein when the axle is pivoted to the extended position the left and right wheels are positioned such that during use the weight force exerted on the left and right wheels maintains the wheel support structures in the extended position.

6. The retractable wheel assembly of claim 2, wherein moving the handle from the first position to the second position causes the axle to pivot from the extended position to the retracted position.

7. The retractable wheel assembly of claim 6 wherein the closable container includes a rigid housing defining left and right wheel wells.

8. The retractable wheel assembly of claim 7, wherein the retractable handle includes first and second upright tubes that are secured to the housing, and a U-shaped handle portion that slidably engages the first and second upright tubes.

9. The retractable wheel assembly of claim 8, wherein the housing includes a generally planar base portion that defines a plurality of elongate standards.

10. The retractable wheel assembly of claim 8 wherein the left and right wheel support structures are pivotably supported in the left and right wheel wells.

11. A retractable wheel assembly for luggage comprising:

an elongate handle comprising a fixed portion and a telescoping portion, the telescoping portion slidably engaging the fixed portion such that the telescoping portion is movable between an extended position and a retracted position:

a closable container attached to the fixed portion of the elongate handle;

a left wheel support structure rotatably supporting a left wheel and a right wheel support structure rotatably supporting a right wheel;

a transverse axle assembly drivably connecting the right wheel support structure to the left wheel support structure, the axle being pivotably attached to the closeable container and pivotable between an extended position and a retracted position;

wherein the left and right wheels rotate about an axis that is offset from the pivot axis of the axle assembly such that when the axle assembly is in the retracted position the wheels are disposed relatively close to the closable container and when the axle assembly is in the extended position the wheels extend relatively further away from the closable container; and wherein the axle assembly is biased towards one of the extended position and the retracted position;

and further wherein the left wheel support structure and the right wheel support structure comprise left and right cowls that enclose most of the left and right wheels, the cowls each including stub axles that pivotably support the cowls.

12. The retractable wheel assembly of claim 11, wherein when the axle assembly is pivoted to the extended position the left and right wheels are positioned such that during use the weight force exerted on the left and right wheels maintains the wheels in the extended position.

13. The retractable wheel assembly of claim 11, wherein moving the handle from the extended position to the retracted position causes the axle assembly to pivot from the extended position to the retracted position.

14. The retractable wheel assembly of claim 13 wherein the closable container includes a rigid housing defining left and right wheel wells.

15. The retractable wheel assembly of claim 14, wherein the housing includes a generally planar base portion that defines a plurality of elongate standards.

16. The retractable wheel assembly of claim 14 wherein the left and right wheel support structures are pivotably supported in the left and right wheel wells.

17. A retractable wheel assembly for a carrier comprising:

a retractable handle that is movable between an first position and a second position:

a closable container attached to the retractable handle;

a left cowl, a right cowl, and an elongate axle fixedly attached to the left and right cowls, the axle being pivotably attached to the closeable container such that the axle is pivotable about a first axis, the axle being pivotable to drive the left and right cowls between an extended position and a retracted position; and a right wheel rotatably mounted to the right cowl and a left wheel rotatably mounted to the left cowl, wherein the left and right wheels rotate about a second axis that is offset from the first axis, and further wherein the left cowl and right cowl are shaped to approximately conform to the shape of the left and right wheels respectively;

wherein when the axle is pivoted to the retracted position the left wheel is cooperatively enclosed by the left cowl and the container, and the right wheel is cooperatively enclosed by the right cowl and the container;

and further wherein when the axle assembly is pivoted to the extended position the left and right wheels are positioned such that during use the weight force exerted on the left and right wheels maintains the wheels in the extended position.

18. The retractable wheel assembly of claim 17, wherein the retractable handle comprises a telescoping structure, and moving the handle from the first position to the second position causes the axle to pivot the left and right cowls to the retracted position.

19. A retractable wheel assembly for a carrier comprising:

a retractable handle that is movable between an first position and a second position:

a closable container attached to the retractable handle;

a left wheel support structure, a right wheel support structure, and an axle drivably attached to the left and right wheel support structures, the axle being pivotably attached to the closeable container such that the axle is pivotable about a first axis, the axle being pivotable to drive the left and right wheel support structures between an extended position and a retracted position; and a right wheel rotatably mounted to the right wheel support structure and a left wheel rotatably mounted to the left wheel support structure, wherein the left and right wheels rotate about a second axis that is offset from the first axis;

wherein the left wheel support structure and the right wheel support structure comprise left and right cowls that enclose most of the left and right wheels and each of the left and right cowls include stub axles that pivotably support the cowls.

* * * * *

UNITED STATES PATENT AND TRADEMARK OFFICE

CERTIFICATE OF CORRECTION

PATENT NO. : 7,503,439 B2
APPLICATION NO. : 11/352742
DATED : March 17, 2009
INVENTOR(S) : T. J. C. O'Shea It is certified that error appears in the above-identified patent and that said Letters Patent is hereby corrected as shown below:

| COLUMN | LINE | |
|---|---|---|
| 7 (Claim 1, line 13) | 39 | "rotatabily" should read --rotatably-- |

Signed and Sealed this

First Day of September, 2009

David J. Kappos

David J. Kappos
*Director of the United States Patent and Trademark Office*